US010408242B1

(12) United States Patent
Chamberlain et al.

(10) Patent No.: US 10,408,242 B1
(45) Date of Patent: Sep. 10, 2019

(54) GARBAGE GUARD APPARATUS AND RELATED METHODS OF INSTALLATION

(71) Applicant: UPSTREAM TECHNOLOGIES, INC., New Brighton, MN (US)

(72) Inventors: Greg David Chamberlain, Arden Hills, MN (US); Richard A. Kuntz, Big Lake, MN (US)

(73) Assignee: UPSTREAM TECHNOLOGIES INC, New Brighton, MN (US)

( * ) Notice: Subject to any disclaimer, the term of this patent is extended or adjusted under 35 U.S.C. 154(b) by 0 days.

(21) Appl. No.: 15/903,794

(22) Filed: Feb. 23, 2018

(51) Int. Cl.
*E03F 5/14* (2006.01)
*F15D 1/00* (2006.01)
(Continued)

(52) U.S. Cl.
CPC ..... *F15D 1/0005* (2013.01); *E03F 5/021* (2013.01); *E03F 5/0403* (2013.01); *E03F 5/14* (2013.01); *F15D 1/025* (2013.01)

(58) Field of Classification Search
CPC .. E03F 5/0403; E03F 5/14; E03F 5/16; B01D 17/0214; B01D 21/0033; B01D 21/2444
(Continued)

(56) References Cited

U.S. PATENT DOCUMENTS 3,391,791 A * 7/1968 Seney ..... E03F 5/14 210/232
5,405,539 A 4/1995 Schneider
(Continued)

FOREIGN PATENT DOCUMENTS

WO WO 2017/182711 * 10/2017

OTHER PUBLICATIONS

Screenshot of Brentwood Industries website https://www.brentwoodindustries.com/stormwater-management/stormtank-shield/.

*Primary Examiner* — Christopher Upton
(74) *Attorney, Agent, or Firm* — Cardle Patent Law, CHTD

(57) ABSTRACT

A garbage guard apparatus is disclosed herein. In various aspects, the garbage guard apparatus may be mounted in a sump comprising an outflow pipe with an outflow pipe entrance that conveys water from the sump, and the sump may be accessed through a manhole entrance of diameter d. The garbage guard apparatus includes multiple panels, with each panel of the multiple panels having panel width W that is less than diameter d of the manhole entrance to allow for passage of each panel through the manhole entrance into the sump, in various aspects. In various aspects flange is formed on each longitudinal side of each panel with all flanges being symmetric to allow a flange of one panel to mate with any flange of any other panel. The panels when flangeably secured to one another within the sump form a panel assembly, in various aspects. The panel assembly so formed is then attached to the sidewall of the sump about the outflow pipe entrance of the outflow pipe with a lower end below an invert of the pipe entrance and an upper end above a crown of the pipe entrance, in various aspects. When so attached to the sidewall of the sump, the panel assembly defines a passage and the water passes from the sump around the lower end of the panel assembly into the passage and then into the pipe entrance of the outflow pipe with buoyant garbage being retained within the sump by the panel assembly, in various aspects. Related kits, methods of use, and methods of assembly are also disclosed herein. This Abstract is presented to meet requirements of 37 C.F.R. § 1.72(b) only. This Abstract is not intended to identify key elements of the apparatus and related kits and methods of use disclosed herein or to delineate the scope thereof.

20 Claims, 12 Drawing Sheets

(51) Int. Cl.
*E03F 5/02* (2006.01)
*F15D 1/02* (2006.01)
*E03F 5/04* (2006.01)

(58) Field of Classification Search
USPC ..... 210/170.03, 532.1, 538, 747.2
See application file for complete search history.

(56) References Cited

U.S. PATENT DOCUMENTS

| | | | | |
|---|---|---|---|---|
| 6,126,817 | A | 10/2000 | Duran et al. | |
| 6,132,603 | A * | 10/2000 | Mokrzycki | B01D 21/2444 210/170.03 |
| 7,011,743 | B2 | 3/2006 | Use et al. | |
| 7,686,961 | B1 * | 3/2010 | Glynne | E03F 5/14 210/170.03 |
| 7,722,763 | B2 * | 5/2010 | Benty | B01D 21/0012 210/170.03 |
| 8,017,004 | B2 | 9/2011 | Crumpler | |
| 8,663,466 | B2 | 3/2014 | Braunwarth et al. | |
| 8,715,507 | B2 | 5/2014 | Gulliver et al. | |
| 9,506,237 | B2 | 11/2016 | Braunwarth et al. | |
| 9,752,600 | B2 | 9/2017 | Hoff et al. | |
| 10,132,071 | B1 * | 11/2018 | Alvarado | E03F 5/14 |
| 2010/0181237 | A1 * | 7/2010 | Duran | B01D 21/2444 210/170.03 |
| 2011/0315616 | A1 * | 12/2011 | Lafond | E03F 5/16 210/163 |
| 2015/0060346 | A1 * | 3/2015 | Bailey | B01D 17/0214 210/232 |
| 2015/0259896 | A1 * | 9/2015 | Jarvis | E03F 5/14 210/131 |
| 2018/0304177 | A1 * | 10/2018 | Kent | E03F 5/14 |

* cited by examiner

GARBAGE GUARD APPARATUS AND RELATED METHODS OF INSTALLATION

BACKGROUND OF THE INVENTION

Field

The apparatus, methods, and kits disclosed herein relate to apparatus for the capture of garbage within a sump.

Background

Water such as, for example, storm water, sanitary wastewater may contain pollutants in the form of garbage that may be sufficiently buoyant to float about the water surface. In various aspects, the water may be channeled through various existing pipes or other drainage channels that pass through one or more sumps. In order to control pollution, it may be desirable to utilize these sumps to capture garbage entrained in the water. In addition, it may be desirable to capture particulates entrained in the water within the sumps.

While devices are available that capture garbage within the sump by preventing the garbage from exiting the sump through outflow pipe(s), these devices may inhibit the flow of water from the sump into the outflow pipe(s). In addition, various existing devices are bulky, difficult to install, and may not be inserted through a manhole entrance into the sump, as the manhole entrance may be limited in size. In addition, the sump may be a confined space that is difficult to work in. The confined space of the sump with limited access into the sump may cause difficulty with retrofitting an existing sump with devices that capture garbage within the sump.

Accordingly, there is a need for improved apparatus that captures floatable garbage within the sump as well as related methods of assembly and kits that, for example, facilitate the retrofit of existing sumps with such apparatus.

BRIEF SUMMARY OF THE INVENTION

These and other needs and disadvantages may be overcome by the apparatus disclosed herein. Additional improvements and advantages may be recognized by those of ordinary skill in the art upon study of the present disclosure.

A garbage guard apparatus is disclosed herein. In various aspects, the garbage guard apparatus may be mounted in a sump comprising an outflow pipe with an outflow pipe entrance that conveys water from the sump, and the sump may be accessed through a manhole entrance of diameter d. The garbage guard apparatus includes multiple panels, with each panel of the multiple panels having panel width W that is less than diameter d of the manhole entrance to allow for passage of each panel through the manhole entrance into the sump, in various aspects. A flange is formed on each longitudinal side of each panel with all flanges being symmetric to allow a flange of one panel to mate with any flange of any other panel, in various aspects. The panels when flangeably secured to one another within the sump form a panel assembly, in various aspects. The panel assembly so formed is then attached to the sidewall of the sump about the outflow pipe entrance of the outflow pipe with a lower end below an invert of the pipe entrance and an upper end above a crown of the pipe entrance, in various aspects. When so attached to the sidewall of the sump, the panel assembly defines a passage and the water passes from the sump around the lower end of the panel assembly into the passage and thence into the pipe entrance of the outflow pipe with buoyant garbage being retained within the sump by the panel assembly, in various aspects. Related kits, methods of assembly, and methods of use are also presented in this disclosure.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1A:
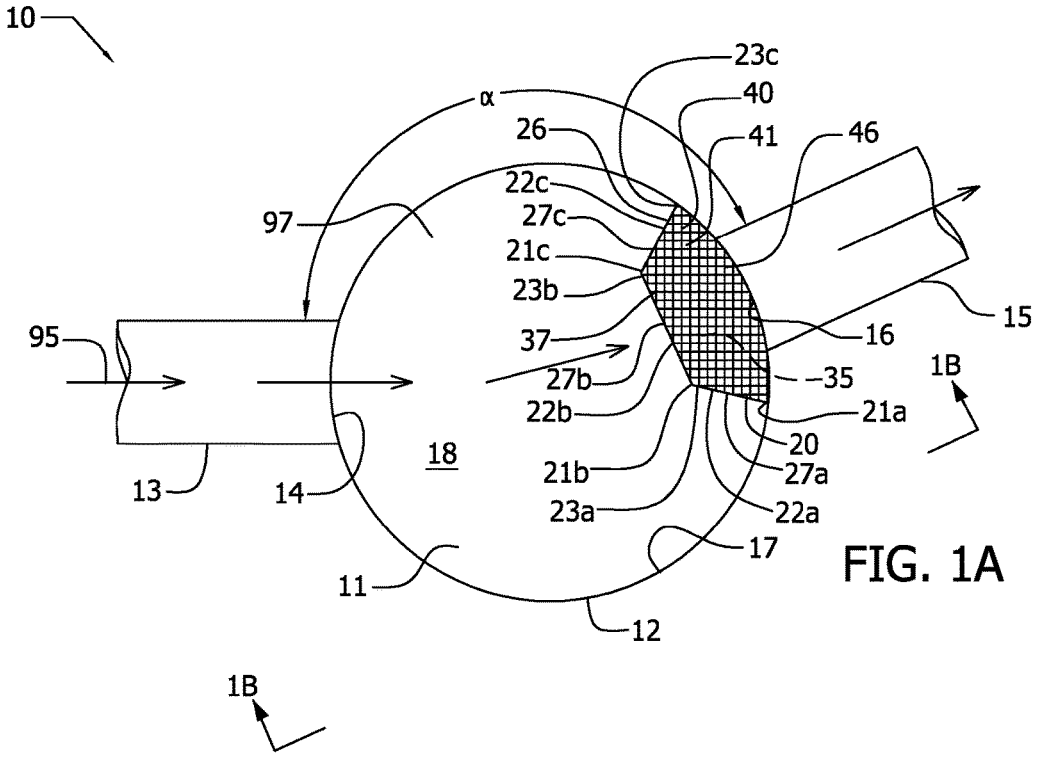
FIG. 1A illustrates by top cross-sectional view an exemplary garbage guard apparatus.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

In various aspects, the garbage guard apparatus disclosed herein includes multiple panels, each panel of the multiple panels having panel width W that is less than a diameter d of a manhole entrance into a sump in order to allow the passage of each panel through the manhole entrance into the sump for assembly within the sump. A flange is formed on each longitudinal side of each panel, and all flanges are symmetric with one another to allow a flange of one panel to mate with any flange of any other panel, in various aspects. The panels may be lowered through the manhole entrance into a sump where the panels may then be assembled into a panel assembly by flanged securement of the panels to one another, in various aspects. In other aspects, the flanges are omitted from the panels and the panels are secured to one another using angle brackets secured along edges of adjacent panels. In some aspects, the panels are planar, while, in other aspects, the panels assume various curved shapes. In various aspects, various features of the garbage guard apparatus may facilitate retrofitting of existing sumps with the garbage guard apparatus as well as installation of the garbage guard apparatus during construction of new sumps. Related kits, methods of assembly, and methods of use are also disclosed herein.

Water is conveyed from the sump through a pipe entrance into the outflow pipe, in various aspects. The panel assembly is attached to a sidewall of the sump about the pipe entrance of the outflow pipe with a lower end of the panel assembly lying below an invert of the pipe entrance and an upper end of the panel assembly lying above a crown of the pipe entrance, in various aspects. The panel assembly defines a passage and the water passes from the sump around the lower end into the passage and thence into the pipe entrance of the outflow pipe with buoyant garbage being retained within the sump by the panel assembly, in various aspects. The passage may be sized to lessen hydraulic losses as the water passes through the passage into the pipe entrance.

A top cap made either of screen or of solid material may be placed on the upper end of the panel assembly to capture garbage when water in the sump overtops the panel assembly. The top cap formed of screen captures garbage entrained in the water while allowing water to pass through the top cap. The top cap formed of solid material blocks flow into the passage around the upper end of the panel assembly, and captures garbage including floating liquid(s) such as oil or grease. Garbage may be removed from the sump through the manhole as necessary.

Figure 1B:
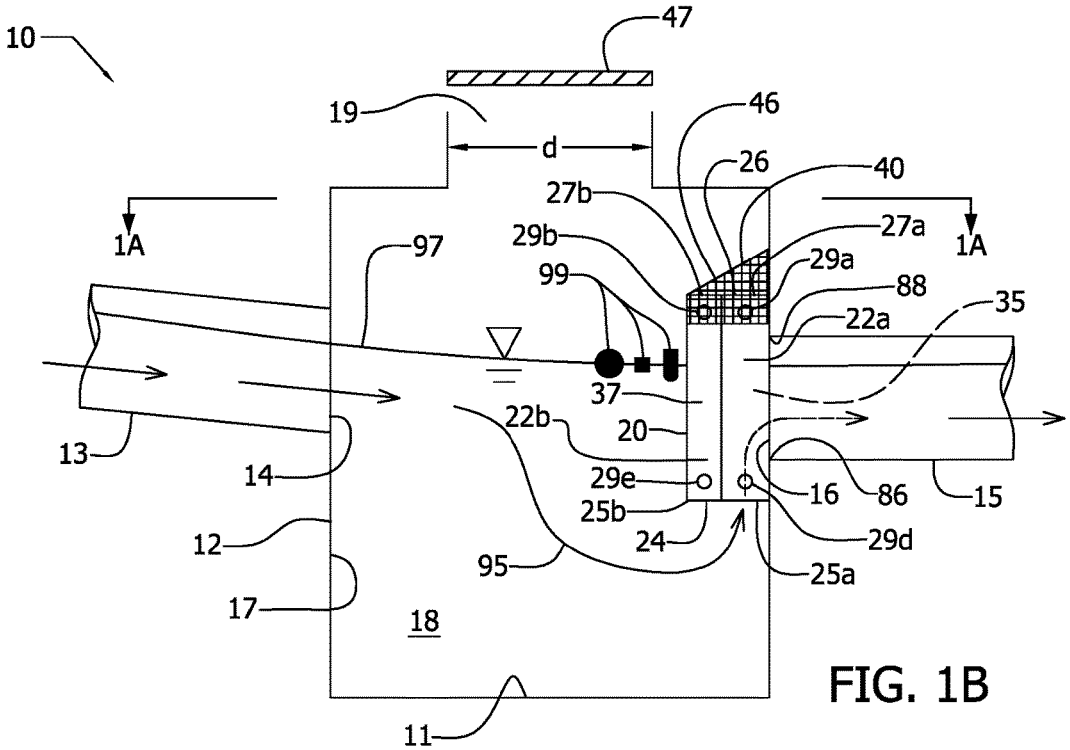
FIG. 1B illustrates by elevation cross-sectional view the exemplary garbage guard apparatus of FIG. 1A.
Figure 1C:
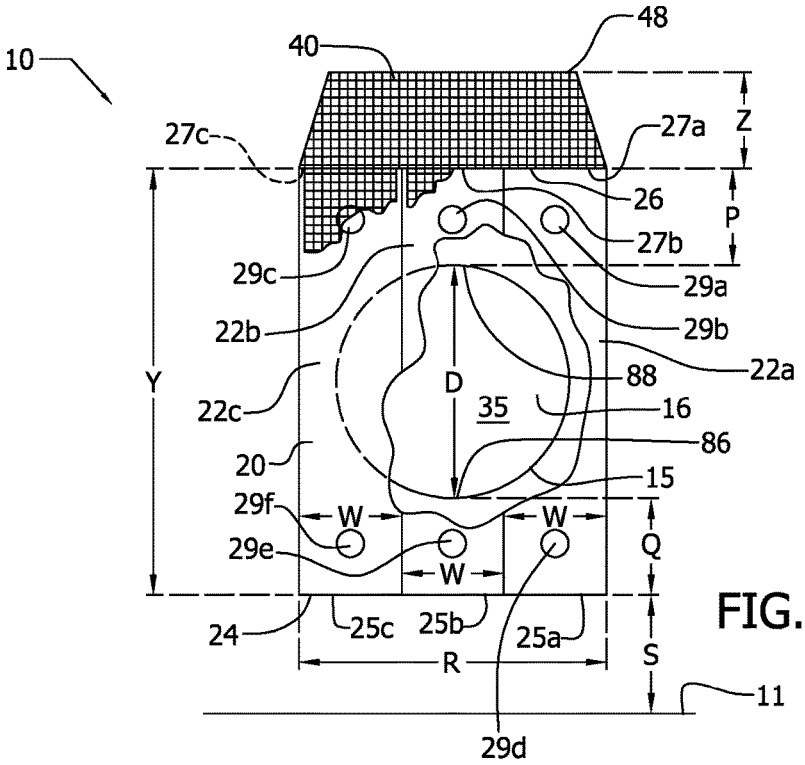
FIG. 1C illustrates by cut-away elevation view portions of the exemplary garbage guard apparatus of FIG. 1A.

FIGS. 1A, 1B, 1C illustrate exemplary garbage guard apparatus 10 including panels 22*a*, 22*b*, 22*c* of panel assembly 20 secured within sump 18 of manhole 12. Panels 22*a*, 22*b*, 22*c* are generally planar and rectangular with panel width W and panel height Y, as illustrated, and may be either square or oblong. In other implementations, the panels may be curved (see FIG. 8). Water 95, as indicated by the arrows in FIGS. 1A, 1B, passes through pipe exit 14 of inflow pipe 13 into sump 18, through sump 18, and from sump 18 through pipe entrance 16 into outflow pipe 15. Panel assembly 20 is secured to side wall 17 of manhole 12 proximate pipe entrance 16 of outflow pipe 15 to capture garbage 99 entrained in the water 95 in order to prevent the garbage 99 from being conveyed from sump 18 into outflow pipe 15 with water 95. Panel assembly 20 retains garbage 99 in sump 18 as garbage 99, which is floating about water surface 97 cannot pass through panel assembly 20. Garbage 99 is thus captured in sump by panel assembly 20 including top cap 40, and garbage 99 may be removed from sump 18 as necessary by user, for example, by vacuum truck or other cleaning devices. Note that, while FIG. 1B includes garbage 99, garbage 99 is omitted from FIG. 1A for clarity of explanation. Garbage 99 may generally have a specific gravity less than that of water, and garbage 99 may include, for example, various floatables, such as, for example, plastic bottles, empty cans or containers, floatable trash, plastics such as Styrofoam, wood based material such as branches, leaves, foliage, and lumber, grease and oils, petrochemicals, fats, and other generally buoyant materials that may be in the form of discrete materials, particles, floatable liquids, or various combinations thereof.

Figure 2A:
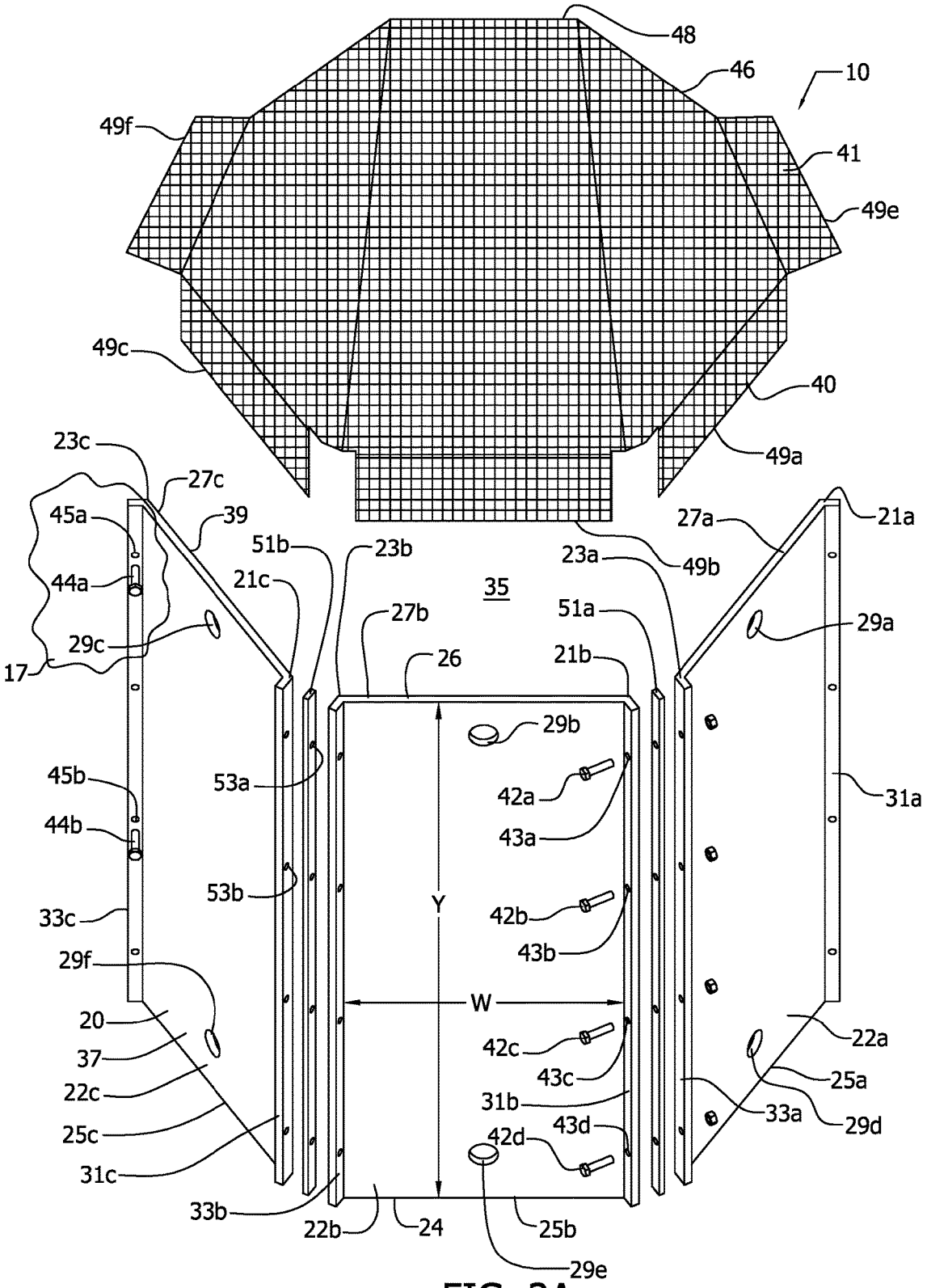
FIG. 2A illustrates by exploded elevation view portions of the exemplary garbage guard apparatus of FIG. 1A.

Panel assembly 20 is formed of panels 22*a*, 22*b*, 22*c* flangeably secured to one another, as illustrated, for example, in FIG. 2A. Side 23*a* of panel 22*a* is attached to side 21*b* of panel 22*b*, and side 23*b* of panel 22*b* is attached to side 21*c* of panel 22*c*, and sides 21*a*, 23*c* of panels 22*a*, 22*c*, respectively, are attached to sidewall 17 to secure panel assembly 20, in this implementation. Sides 25*a*, 25*b*, 25*c* of panels 22*a*, 22*b*, 22*c*, respectively, form lower end 24 of panel assembly 20, and sides 27*a*, 27*b*, 27*c* of panels 22*a*, 22*b*, 22*c*, respectively, form upper end 26 of panel assembly 20, as illustrated in FIGS. 1A, 1B (also see FIG. 2A). Panels 22*a*, 22*b*, 22*c* may be formed of plastic, such as polyvinyl chloride (PVC) in certain implementations. In various implementations, panels 22*a*, 22*b*, 22*c* may be formed, for example, of galvanized sheet steel, stainless steel, high density polyethylene (HDPE), fiberglass, aluminum, or combinations thereof, and the material(s) that forms panels 22*a*, 22*b*, 22*c* in a specific implementation may be selected to resist corrosion by the particular aqueous environment within which the panels 22*a*, 22*b*, 22*c* will be used in that specific implementation.

Figure 2B:
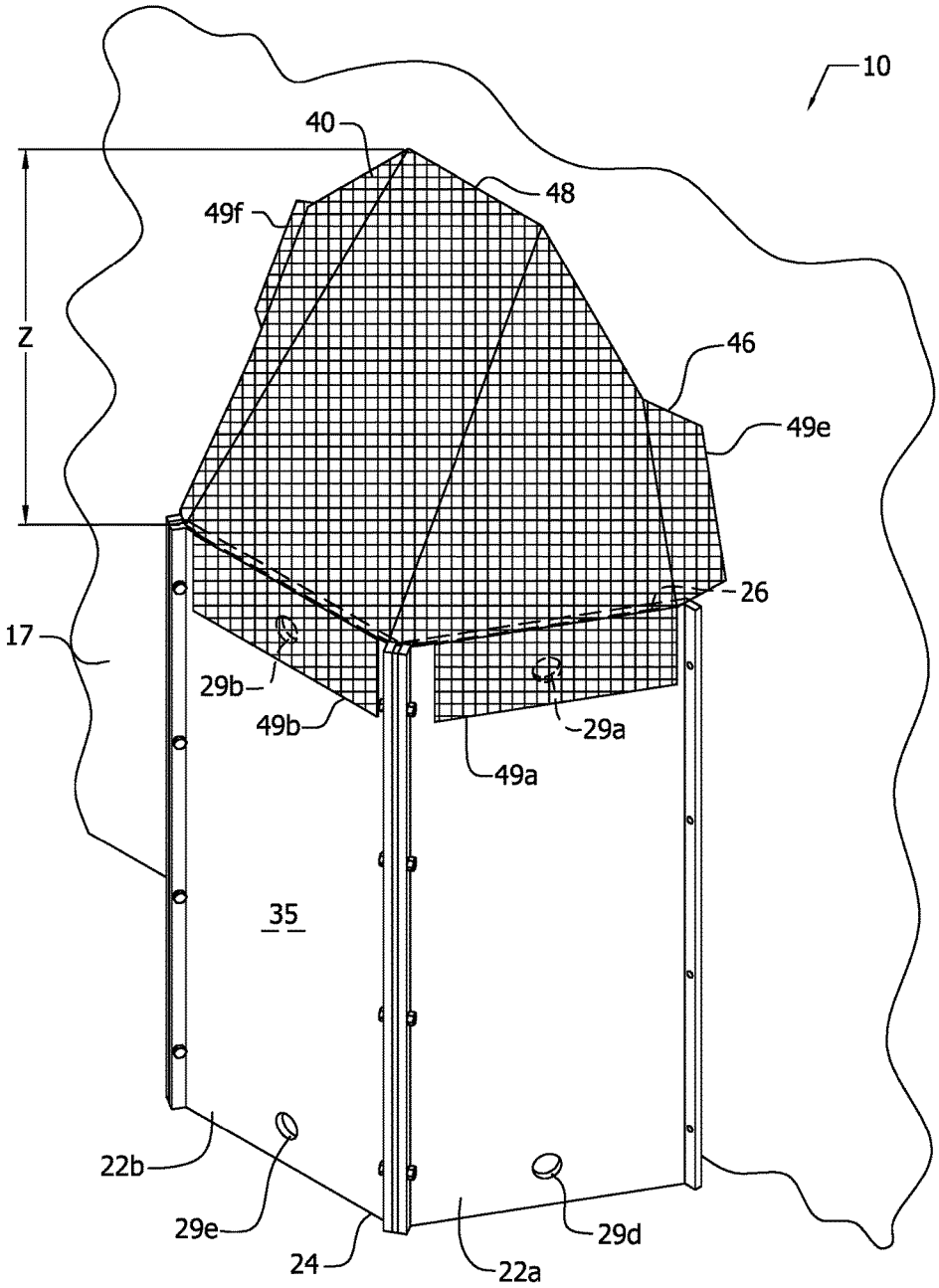
FIG. 2B illustrates by perspective view portions of the exemplary garbage guard apparatus of FIG. 1A.

As illustrated in FIG. 2B, when secured to sidewall 17, inner side 39 of panel assembly 20 defines passage 35 between lower end 24 and upper end 26, and water 95 flows from sump 18 into passage 35 through lower end 24 and from passage 35 into outflow pipe 15 through pipe entrance 16. The buoyancy of garbage 99 holds garbage 99 proximate water surface 97 as water 95 flows into passage 35 through lower end 24 and, thence, into outflow pipe 15 through pipe entrance 16. Panel assembly 20 blocks garbage 99 from entering outflow pipe 15 thereby retaining garbage 99 in sump 18. Garbage 99 may collect about outer side 37 of panel assembly 20 that faces outward into sump 18.

Top cap 40 is secured over passage 35 at upper end 26 to enclose passage 35 at upper end 26 in order to prevent garbage 99, which generally floats about water surface 97, from entering passage 35 at upper end 26 in the event that water surface 97 in sump 18 approaches or overtops the upper end 26 of panel assembly 20, in this implementation. Top cap 40 may be formed of galvanized steel, stainless steel, copper, brass, plastic, aluminum, or other corrosion resistant material or combination of materials, in various implementations. Top cap 40 of exemplary garbage guard apparatus 10 is formed as a screen 46 having apertures, such as aperture 41, sized to allow passage of water through top cap 40 from sump 18 into passage 35 and thence into pipe entrance 16 of outflow pipe 15 while retaining garbage 99 in sump 18. Garbage 99 of sizes larger than aperture 41 is captured by screen 46, and, thus, retained in sump 18. Screen 46 includes screens as well as sheets of perforated material, in various implementations. In other implementations, such as garbage guard apparatus 400 illustrated in FIG. 7, for example, wherein garbage includes floating liquids such as greases, oils, fats, petrochemicals, top cap 440 is formed of solid material 446 (no apertures), to trap floating liquids for later removal should the water surface in the sump, such as water surface 97 in sump 18, approach or overtop the upper end 426 of panel assembly 420.

As illustrated in FIG. 1A, inflow pipe 13 and outflow pipe 15 are set at angle α with respect to one another, and angle—a may vary between 0° and 360°, in various implementations. Multiple inflow pipes, such as inflow pipe 13, or multiple outflow pipes, such as outflow pipe 15, may flow into or out from sump 18, respectively, and the pipe exits, such as pipe exit 14, and the pipe entrances, such as pipe entrance 16, may have various elevations with respect to sump floor 11, in various implementations. Note that in some implementations, inflow pipe 13 is omitted so that sump 18 has only outflow pipe 15. Inflow pipe 13 and outflow pipe 15 may have various cross-sectional shapes such as round, ovoid, rectangular, square, arched, horseshoe, or elliptical, and may differ from one another in cross-sectional shape, as would be readily recognized by those of ordinary skill in the art upon study of this disclosure. Inflow pipe 13 and outflow pipe 15 may be made of steel, concrete, clay, cast iron, brick, or other material or combinations of materials, as would be readily recognized by those of ordinary skill in the art upon study of this disclosure. Manhole 12 including sump floor 11 and sidewall 17 may be formed of various materials or combinations of materials such as pre-cast concrete, cast-in-place concrete, brick, masonry, and so forth, as would be readily recognized by those of ordinary skill in the art upon study of this disclosure.

As illustrated in FIG. 1B, manhole 12 has manhole entrance 19 of diameter d that is enclosed by manhole cover 47 (illustrated set apart from manhole entrance 19). Manhole cover 47 is removable to allow access to sump 18 through manhole entrance 19. Manhole cover 47 may be a generally solid cover that encloses sump 18 or manhole cover 47 may be formed as a grating, grill, or so forth, in various implementations. Manhole entrance 19 may be circular, as illustrated, or may assume other shapes such as rectangular or square in other implementations, and manhole cover 47 may be correspondingly shaped to conform to the shape of manhole entrance 19. Diameter d includes equivalent dimension(s) for a non-circular manhole entrance.

FIG. 1C illustrates placement of panel assembly 20 with respect to pipe entrance 16 of outflow pipe 15. Note that panels 22*a*, 22*b*, 22*c* of panel assembly 20, which are planar in this implementation, are generally vertically aligned in a vertical plane, in this implementation. Diameter D is the diameter of the outflow pipe 15 at pipe entrance 16, which has invert 86 and crown 88, as illustrated.

Table 1 includes exemplary dimensions of exemplary garbage guard apparatus 10 as illustrated in FIG. 1C. Because the dimensions given in Table 1 are exemplary, it should be recognized that the dimensions of various implementations may differ from the exemplary values given in Table 1, for example, in order to conform to a specific application. Diameter D may be, for example, a standard pipe diameter. S may be selected so as to allow water flow under panel assembly 20 without inhibiting flow while trapping garbage 99. Panel width W and panel height Y may be selected according to D, for example, with panel width W and panel height Y being larger in installations with a larger diameter D of the outflow pipe 15 at pipe entrance 16. Top cap height Z may be altered from the exemplary value given in Table 1 to any height that suits a specific application. Because diameter d of manhole entrance 19 may restrict placement within sump 18, panel width W is selected to be less than diameter d of manhole entrance 19 in order that panels, such as panels 22*a*, 22*b*, 22*c*, may be passed through manhole entrance 19 into sump 18 for fabrication into panel assembly 20 within sump 18. While panels 22*a*, 22*b*, 22*c* are illustrated as having similar panel width W, the panel width W of each of panels 22*a*, 22*b*, 22*c* may differ, in other implementations.

TABLE 1

| Label | Description | Exemplary Dimension |
|---|---|---|
| D | Outflow Pipe Diameter at Pipe Entrance | Standard pipe diameter |
| P | Panel height Above Outflow Pipe Crown | At least 6 inches |
| Q | Panel height Below Outflow Pipe Invert | At least 12 inches |
| R | Width of Panel Assembly | >D |
| S | Height of Panel Above Sump Floor | At Least 12 inches |
| W | Panel Width | 11 inches or 16 inches |
| Y | Panel height | 36 inches or 48 inches |
| Z | Top cap Height Above Panels | 12 inches |

FIGS. 2A, 2B further illustrates assembly of panels 22*a*, 22*b*, 22*c* and top cap 40 into at least portions of panel assembly 20. As illustrated in FIG. 2A, sides 21*a*, 21*b*, 21*c* of panels 22*a*, 22*b*, 22*c* include flanges 31*a*, 31*b*, 31*c*, respectively, and sides 23*a*, 23*b*, 23*c* of panels 22*a*, 22*b*, 22*c* include flanges 33*a*, 33*b*, 33*c*, respectively. Flange 33*a* of panel 22*a* is attached to flange 31*b* of panel 22*b* in order to attach side 23*a* of panel 22*a* to side 21*b* of panel 22*b*, as illustrated. Flange 33*b* of panel 22*b* is attached to flange 31*c* of panel 22*c* in order to attach side 23*b* of panel 22*b* to side 21*c* of panel 22*c*, as illustrated. Fasteners, such as fasteners 42*a*, 42*b*, 42*c*, 42*d*, are insertably engaged through holes, such as holes 43*a*, 43*b*, 43*c*, 43*d*, provided matingly in flanges 31*b*, 31*c*, 33*a*, 33*b* to attach side 23*a* of panel 22*a* to side 21*b* of panel 22*b* and to attach side 23*b* of panel 22*b* to side 21*c* of panel 22*c*, as illustrated. Fasteners, such as fastener 42*a*, 42*b*, 42*c*, 42*d*, include, for example, bolts, screws, rivets, clips, and combinations thereof, and various numbers of holes in the flanges and corresponding fasteners may be provided to join the flanges to one another, in various implementations. In this implementation, flanges 31*a*, 33*a*, flanges 31*b*, 33*b*, and flanges 31*c*, 33*c* are unitary with panels 22*a*, 22*b*, 22*c*, respectively, and may be formed during manufacture of the panels. In other implementations, panels may not have flanges formed during manufacture, but instead use angle brackets (see FIGS. 9A, 9B) that are manufactured separately and affixed to each panel at time of installation to secure the panels to one another. Angle brackets, such as angle brackets 663*a*, 663*b* of FIGS. 9A, 9B, may be used in addition to flanges 31*a*, 33*a*, flanges 31*b*, 33*b*, and flanges 31*c*, 33*c*, to join the panels 22*a*, 22*b*, 22*c* to one another with the angle brackets reinforcing the flanges.

Top cap 40 is then overlaid upon the assembly of panels 22*a*, 22*b*, 22*c* at upper end 26 to enclose passage 35 at upper end 26 of panel assembly 20. When top cap 40 is secured to upper end 26 of panel assembly 20, aprons 49*a*, 49*b*, 49*c* extend over portions of outer side 37 of panel assembly 20 to enclose ports 29*a*, 29*b*, 29*c*, respectively, to prevent garbage, such as garbage 99 from passing through ports 29*a*, 29*b*, 29*c* into passage 35 and thence into outflow pipe 15.

Various fasteners may be used to secure top cap 40 to panel assembly 20. Aprons 49*e*, 49*f* may be secured to sidewall 17 of sump 18 to further secure top cap 40 in place at upper end 26 of panel assembly 20.

As illustrated in FIG. 2A, spacers 51*a*, 51*b* are optionally interposed between flanges 33*a*, 31*b* and between flanges 33*b*, 31*c*, respectively. Spacers, such as spacers 51*a*, 51*b*, are optional, and accordingly spacers may be omitted in certain implementations. Spacers 51*a*, 51*b* may be made of rubber, neoprene, or other such flexible conformable, sealing material. When included, spacers 51*a*, 51*b* may, for example, seal any gap(s) between flanges 33*a*, 31*b* and between flanges 33*b*, 31*c* to inhibit the flow of water 95 between flanges 33*a*, 31*b* and between flanges 33*b*, 31*c*, or spacers 51*a*, 51*b* may aid in the mating of flanges 33*a*, 31*b* and the mating of flanges 33*b*, 31*c*. Holes, such as holes 53*a*, 53*b*, may be provided in spacers 51*a*, 51*b*, and fasteners, such as fasteners 42*a*, 42*b*, 42*c*, 42*d*, may be received within the holes in spacers 51*a*, 51*b*. In order to prevent leakage between the panels, flanges, such as flanges 31*a*, 31*b*, 31*c*, 33*a*, 33*b*, 33*c* may be, for example, at least 1" in width (inside measurement). In implementations that include spacers, such as spacers 51*a*, 51*b*, the spacers may be sized in conformity to the flanges.

As illustrated in FIG. 2A, flanges 31*a*, 33*c* may be attached to sidewall 17 using fasteners, such as fasteners 44*a*, 44*b*, insertably received in holes, such as hole 45*a*, 45*b*, to engage flanges 31*a*, 33*c* with sidewall 17, and, thus, attach panel assembly 20 to sidewall 17. Fasteners, such as fastener 44*a*, 44*b*, include, for example, bolts, concrete anchors, masonry screws, and combinations thereof, in various implementations, as may depend upon the material of sidewall 17, and various types of fasteners may be used throughout garbage guard apparatus 10 as may be appropriate. Various numbers of holes, such as holes 45*a*, 45*b*, and corresponding fasteners, such as fasteners 44*a*, 44*b*, may be provided for attachment of the flanges, such as flanges 31*a*, 33*c*, to sidewall 17 of manhole 12, in various implementations. Fasteners, such as fasteners 42*a*, 42*b*, 42*c*, 42*d*, 44*a*, 44*b*, may be, for example, 7/16" in diameter and made of stainless steel, galvanized steel, or other corrosion resistive material(s). In various implementations, shims, furring strips, spacers, gaskets, and so forth (not shown) may be interposed between the flanges 31*a*, 33*c* and sidewall 17, and flanges 31*a*, 33*c* may be anchored thereto and not directly to sidewall 17, as would be readily recognized by those of ordinary skill in the art upon study of this disclosure.

FIG. 2B illustrates the assembled panel assembly 20 secured to sidewall 17 of sump 18 with panels 22*a*, 22*b*, 22*c* secured to one another. Top cap 40, as illustrated in FIG. 2B, is secured to panels 22*a*, 22*b*, 22*c* to enclose passage 35 at upper end 26 of panel assembly 20 in order to prevent the inflow of garbage 99 into passage 35, and, thence, into outflow pipe 15. Aprons 49*e*, 49*f* and portions of top cap 40 proximate top cap edge 48 are secured to sidewall 17, and aprons 49*a*, 49*b*, 49*c* are secured to panels 22*a*, 22*b*, 22*c* to secure top cap 40 in place. Note that top cap edge 48 of top cap 40, in this implementation, is elevated above upper end 26 of panel assembly 20 by amount Z to slant top cap 40 to prevent garbage 99 from accumulating on top cap 40. Garbage 99 would roll off of top cap 40, which is slanted, in this implementation. In other implementations, top cap 40 may be generally horizontal (Z 0).

Figure 3A:
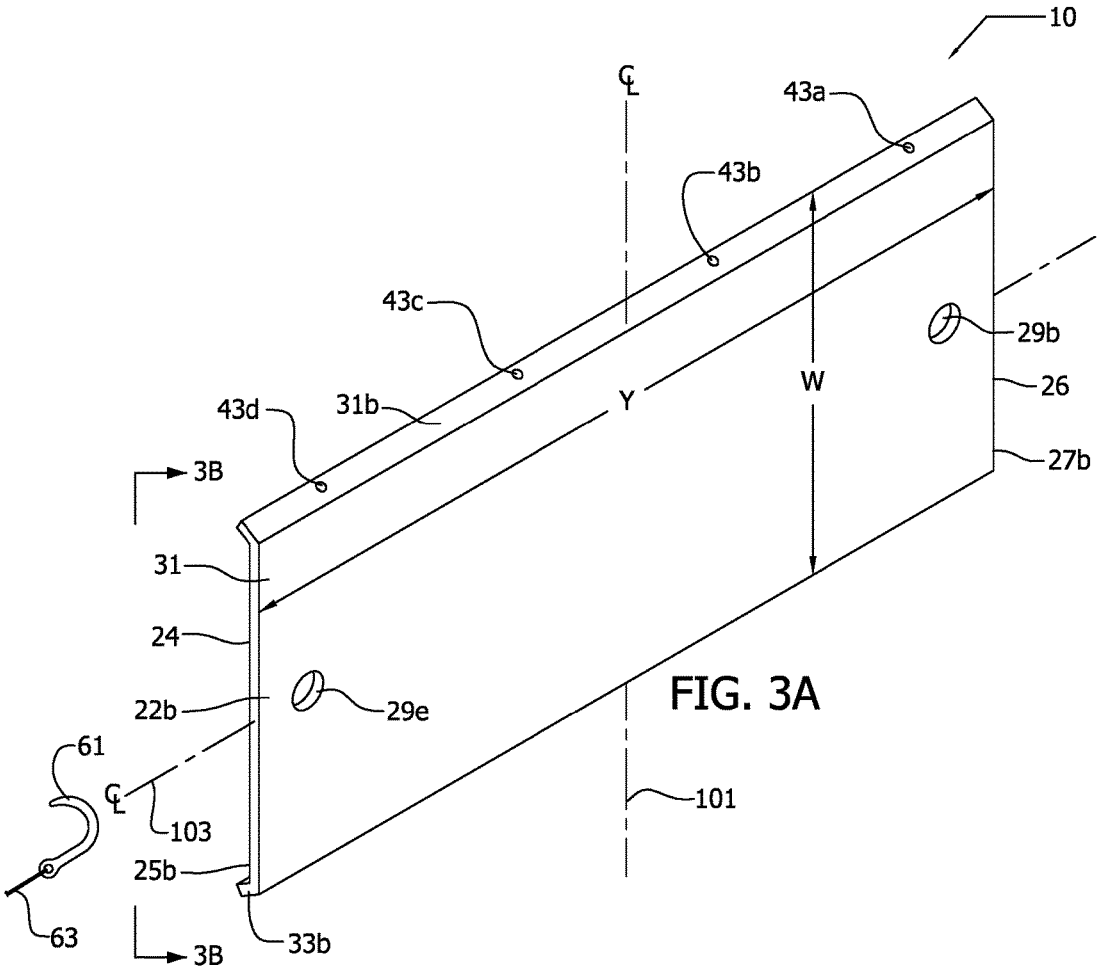
FIG. 3A illustrates by perspective view portions of the exemplary garbage guard apparatus of FIG. 1A.
Figure 3B:
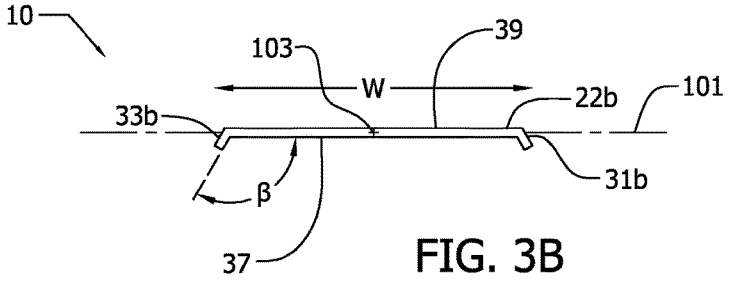
FIG. 3B illustrates by end view portions of the exemplary garbage guard apparatus of FIG. 1A.

FIGS. 3A, 3B illustrated panel 22*b* of panel assembly 20, and panels 22*a*, 22*b* may be essentially the same as panel 22*b*, in this configuration. As illustrated, panels 22*a*, 22*b*, 22*c* are rectangular in shape with panel width W and panel height Y. Panel width W, which is less than panel height Y, may be less than diameter d of manhole entrance 19 to allow insertion of panels 22*a*, 22*b*, 22*c* into sump 18 through manhole entrance 19. Ports 29*a*, 29*b*, 29*c* are disposed in panels 22*a*, 22*b*, 22*c* proximate top sides 27*a*, 27*b*, 27*c*, respectively, to allow the user to manipulate panels 22*a*, 22*b*, 22*c*. For example, either port 29*a*, 29*d*, port 29*b*, 29*d*, and port 29*c*, 29*f* of panel 22*a*, 22*b*, 22*c*, respectively, may be engaged with cable 63 by hook 61 including other attachment mechanisms. Then cable 63, which may be under control of a hoist (not shown), may be used to lower panels 22*a*, 22*b*, 22*c* lengthwise into sump 18 through manhole entrance 19 for assembly into panel assembly 20 within sump 18 and attachment to sidewall 17. Cable 63 may be, for example, a cable or a rope, and cable 63 may be manipulated by hand or by a hoist including, for example, a come-along, crane, or winch.

As illustrated, panel 22*b* is symmetric about lateral axis 101 that passes through panel 22*b* midway of length Y, and panel 22*b* is symmetric about longitudinal axis 103 that passes through panel midway of width W. Holes, such as holes 43*a*, 43*b*, 43*c*, 43*d*, are disposed symmetrically along flanges 31*b*, 33*b* with respect to one another and with respect to lateral axis 101. For example, holes 43*a*, 43*b* are placed at the same distance from lateral axis 101 as holes 43*d*, 43*c*, respectively. Panels 22*a*, 22*b*, 22*c* are symmetric with respect to one another so that the holes in the flanges align with one another when the flanges are adjoined, with holes in the same position with respect to the lateral axis in the flanges. For example, flange 31*b* of panel 22*b* will mate with any of flanges 31*a*, 33*a* of panel 22*a* or flanges 31*c*, 33*c* of panel 22*c* and the holes will align. Thus, panels 22*a*, 22*b*, 22*c* may be lowered into sump 18 by either of ports 29*a*, 29*d*, ports 29*b*, 29*e*, and ports 29*c*, 29*f*, respectively, and will be properly oriented for assembly including mating engagement of the flanges within sump 18 (may require rotation about longitudinal axis, such as longitudinal axis 103 to achieve proper orientation). Note that, as illustrated, flanges 31*a*, 33*a*, 31*b*, 33*b*, 31*c*, 33*c* are faced outward as part of outer side 37 of panel assembly 20 to allow the user to place fasteners through the flanges in order to join the flanges together or to engage flanges with the sidewall 17. Orientation of flanges 31*a*, 33*a*, 31*b*, 33*b*, 31*c*, 33*c* outward opposite of passage 35, as illustrated, may facilitate assembly of panel assembly 20 within sump 18 as the user may access the flanges from sump 18 not from within passage 35. As illustrated in FIG. 3B, flanges 31*b*, 33*b*, are set at angle β with respect to the remainder of panel 32*b*. Angle β may be for example, about 120°, and angle β may range from about 90°, to about 180°, in various implementations.

Figure 4:
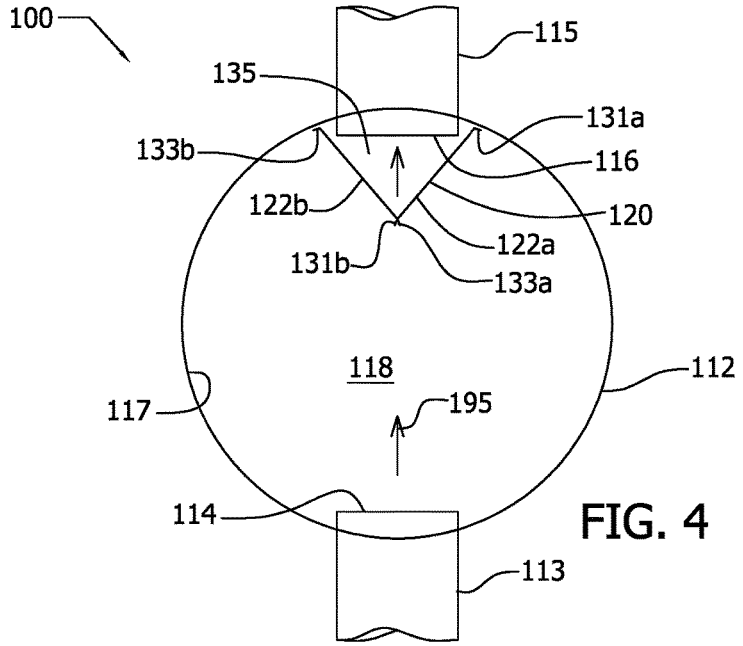
FIG. 4 illustrates by top cross-sectional view a second exemplary garbage guard apparatus.

FIG. 4 illustrates exemplary garbage guard apparatus 100 including panel assembly 120 secured within sump 118 of manhole 112. Panel assembly 120 is formed of two panels, panels 122*a*, 122*b*, in this implementation. Water 195, as indicated by the arrows passes through pipe exit 114 of inflow pipe 113 into sump 118, through sump 118, and from sump 118 through pipe entrance 116 into outflow pipe 115. Panel assembly 120 is secured to sidewall 117 of sump 118 proximate pipe entrance 116 of outflow pipe 115 to capture garbage, such as garbage 99, entrained in the water 195 as water 195 passes from sump 118 into outflow pipe 115.

As illustrated in FIG. 4, panels 122*a*, 122*b* are joined together to form panel assembly 120 having a V-shaped structure. Flange 133*a* of panel 122*a* is joined to flange 131*b* of panel 122*b* by fasteners (not shown) received in holes (not shown) disposed about flanges 133*a*, 131*b* for that purpose thereby forming panel assembly 120. Panel assembly 120 is attached to sidewall 117 of sump 118 by fasteners engaged with flanges 131*a*, 133*b*.

Figure 5:
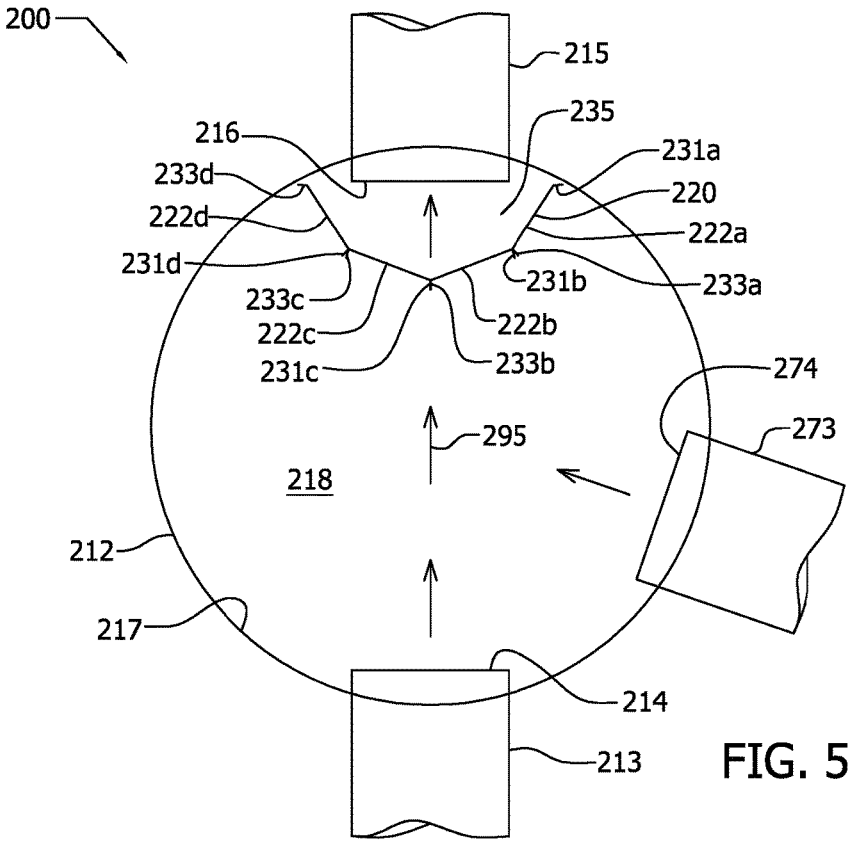
FIG. 5 illustrates by top cross-sectional view a third exemplary garbage guard apparatus.

FIG. 5 illustrates exemplary garbage guard apparatus 200 including panel assembly 220 secured within sump 218 of manhole 212. Panel assembly 220 is formed of four panels, panels 222*a*, 222*b*, 222*c*, 222*d*, in this implementation. The panel assembly, such as panel assembly 220, may be formed of any number of panels as may be required to accommodate the size of the outflow pipe 215, in various implementations. Water 295, as indicated, passes through first pipe exit 214 of first inflow pipe 213 into sump 218 and from second pipe exit 274 of second inflow pipe 273 into sump 218. Water 295 flow through sump 218 and thence into outflow pipe 215 through pipe entrance 216. Panel assembly 220 is secured to sidewall 217 of sump 218 proximate pipe entrance 216 of outflow pipe 215 to capture garbage, such as garbage 99, entrained in the water 295 in order to prevent the garbage from passing into outflow pipe 215.

As illustrated in FIG. 5, panels 222*a*, 222*b*, 222*c*, 222*d* are joined together to panel assembly 220. Flange 233*a* of panel 222*a* is joined to flange 231*b* of panel 222*b*, flange 233*b* of panel 222*b* is joined to flange 231*c* of panel 222*c*, flange 233*c* of panel 222*c* is joined to flange 231*d* of panel 222*d* to form panel assembly 220. Flanges 231*a*, 233*d* are attached to sidewall 217 of sump 218 to secure panel assembly 220 to sidewall 217. Various fasteners (not shown) are received in holes (not shown) disposed about flanges 231*a*, 233*a*, 231*b*, 233*b*, 231*c*, 233*c*, 231*d*, 233*d* to join the flanges 233*a*, 231*b*, 233*b*, 231*c*, 233*c*, 231*d* together or to secure flanges 231*a*, 233*d* to sidewall 217, as illustrated in FIG. 5.

Figure 6A:
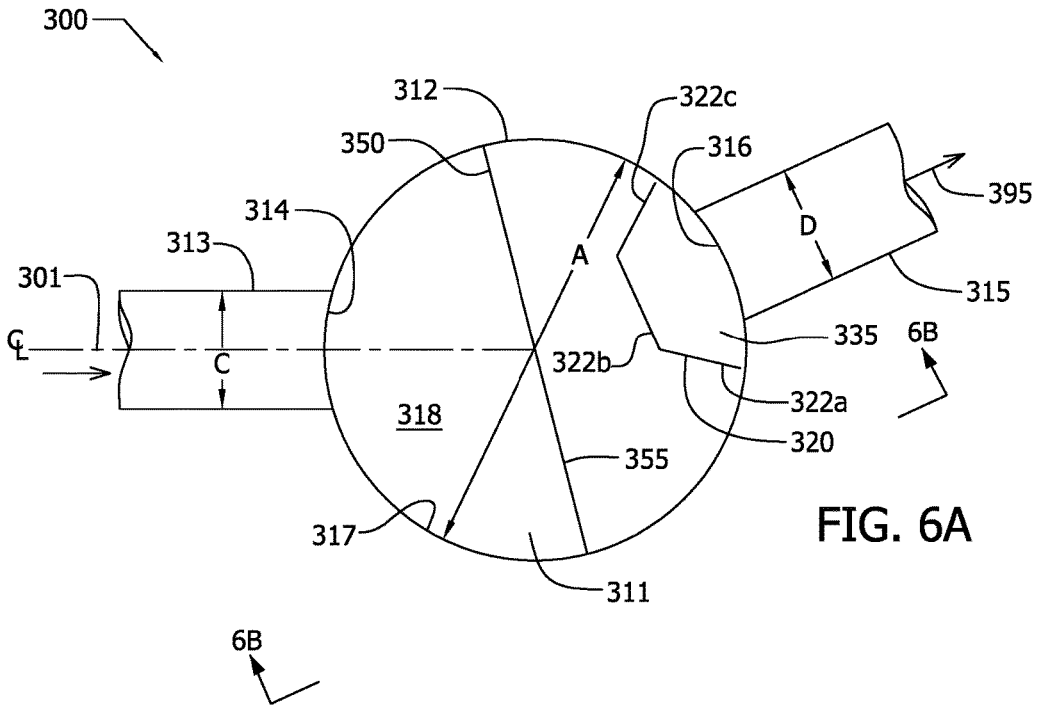
FIG. 6A illustrates by top cross-sectional view a fourth exemplary garbage guard apparatus.
Figure 6B:
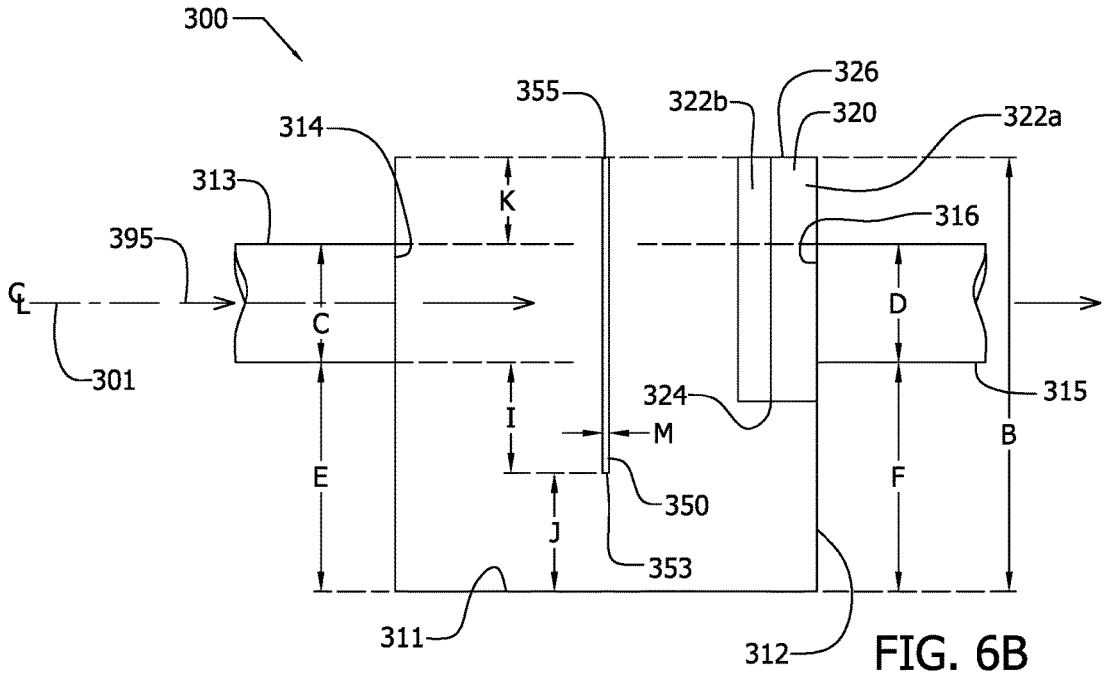
FIG. 6B illustrates by elevation cross-sectional view the fourth exemplary garbage guard apparatus of FIG. 6A.
Figure 6C:
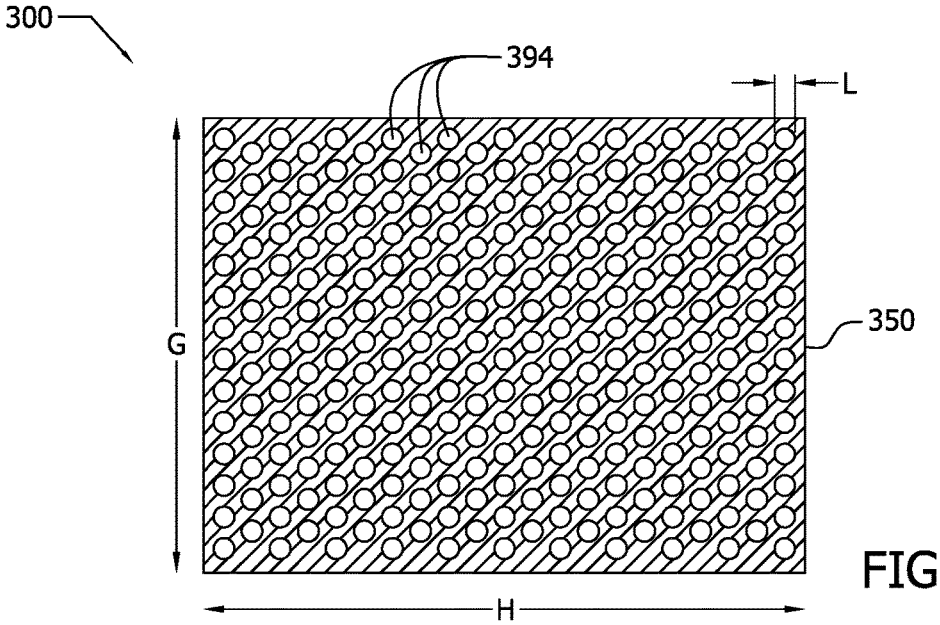
FIG. 6C illustrates by frontal view portions of the fourth exemplary garbage guard apparatus of FIG. 6A.

FIGS. 6A, 6B, 6C illustrate exemplary garbage guard apparatus 300 including panel assembly 320 and flow baffle 350 secured within sump 318 of manhole 312. In this implementation, panel assembly 320 is formed of panels 322*a*, 322*b*, 322*c* that are attached to one another and to sidewall 317 of manhole 312. Water 395, as indicated, passes through pipe exit 314 of inflow pipe 313 into sump 318 and through sump 318 into outflow pipe 315 through pipe entrance 316. Panel assembly 320 is secured to sidewall 317 of sump 318 proximate pipe entrance 316 of outflow pipe 315 to capture garbage, such as garbage 99, entrained in the water 395 in order to prevent the garbage from passing into outflow pipe 315.

Flow baffle 350 is disposed within sump 318, as illustrated in FIGS. 6A, 6B, to dissipate the energy of flow entering sump 318 from inflow pipe 313. Flow baffle 350 is generally planar and is disposed vertically within sump 318. Flow along centerline 301 of inflow pipe 313 strikes the plane of the flow baffle 350. Sediment may be carried into sump 318 by inflow of water 395 from inflow pipe 313, and flow baffle 350 may enhance the capture of sediment within sump 318. The position, size, and shape of flow baffle 350, and the size and shape of the openings 394 within flow baffle 350, are selected to reduce or eliminate scour and washout of sediment from sump 318 into outflow pipe 315, in various implementations. Thus, the combination of flow baffle 350 with panel assembly 320 may enhance the removal of both sediment and garbage from water 395 as water 395 passes through sump 318.

When flow baffle 350 is emplaced in sump 318, water 395 may flow over side 355 of flow baffle 350 as a weir, and water may flow between side 353 of flow baffle 350 and sump floor 311. Openings 394 pass through flow baffle 350 between surface 356 and surface 358 are disposed about flow baffle 350, and water 395 may flow through openings 394 of flow baffle 350. The openings 394 may be generally similar in size and shape, as illustrated in FIG. 6C, or the openings, such as openings 394, may vary in size, shape, or combinations of size and shape, in other implementations. Openings, such as openings 394, may be disposed about the flow baffle 350 such that the flow baffle 350 may have a percent of open area ranging from about 40% to about 50%, and the diameter including other equivalent dimension of openings 394 may range from about 2 inches to about 6 inches, in various implementations. Table 2 includes exemplary dimensions of an exemplary flow baffle 350 of exemplary garbage guard apparatus 300. Note that the dimensions given in Table 2 are exemplary only may be altered in various implementations, for example, in order to conform to a specific application. Additional details of flow baffles, such as flow baffle 350 may be found in U.S. Pat. No. 8,715,507 issued 6 May 2014 to Gulliver et al., which is hereby incorporated by reference in its entirety herein. U.S. Pat. No. 9,506,237 issued 29 Nov. 2016 to Braunwarth et al. and U.S. Pat. No. 8,663,466 issued 4 Mar. 2014 to Braunwarth et al. are also hereby incorporated by reference in their entireties herein.

TABLE 2

| Label | Description | Example Dimension |
|---|---|---|
| A | Sump Diameter | 4 foot |
| B | Sump Height | 4 foot |
| C | Inflow Pipe Diameter | 15 inch |
| D | Outflow Pipe Diameter | 15 inch |
| E | Inflow Pipe Invert Height Above Sump floor | 4 foot |
| F | Outflow Pipe Invert Height Above Sump floor | 4 foot |
| G | Flow Baffle Height | I + C + K |
| H | Flow baffle Width | A (in some implementations) |
| I | Inlet invert Height from Flow Baffle Bottom | 1 ft. |
| J | Flow Baffle Bottom to Sediment Height | ≥1 foot |
| K | Flow Baffle Top to net Pipe Crown | ≥0.5 foot |
| L | Flow Baffle Opening Diameter (i.e., openings 394) | 1 inch to 3 inches |
| M | Flow Baffle Thickness | 0.125 inches |

Figure 7:
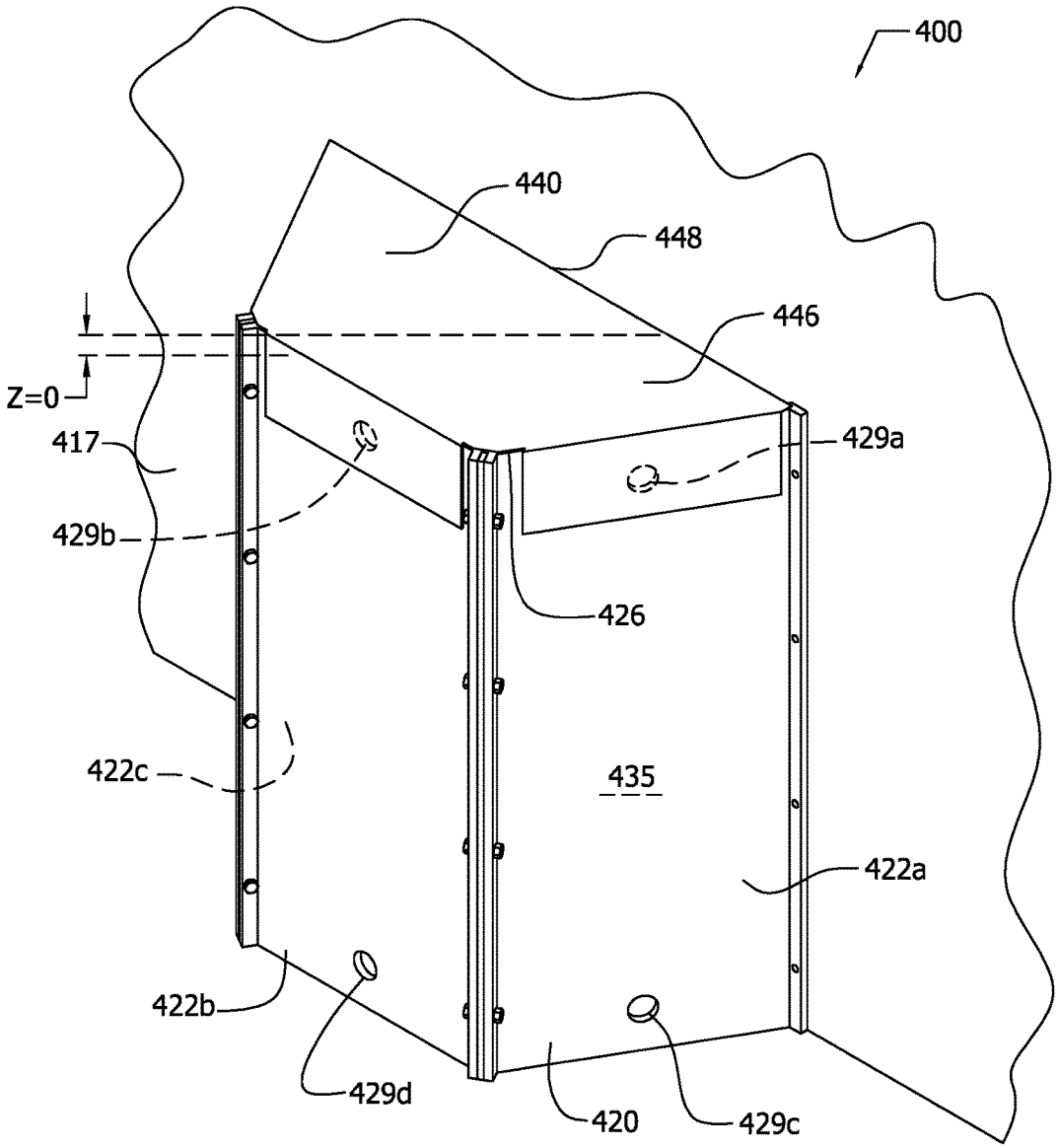
FIG. 7 illustrates by perspective view a fifth exemplary garbage guard apparatus.

FIG. 7 illustrates exemplary garbage guard apparatus 400 including panels 422*a*, 422*b*, 422*c* secured to one another and secured to sidewall 417 as panel assembly 420. Top cap 440, as illustrated in FIG. 7, is secured to panels 422*a*, 422*b*, 422*c* to enclose passage 435 at upper end 426 of panel assembly 420 in order to prevent the inflow of garbage, such as garbage 99, into passage 435, through upper end 426. Top cap 440, in this implementation, is generally horizontal ($Z \approx 0$), and top cap 440 is formed of solid material 446 through which water and other liquids will not pass in order to capture, for example, garbage in the form of grease and oils, petrochemicals, fats, and other generally buoyant liquids. In exemplary garbage guard apparatus 10, in which top cap 40 is formed of screen 46, the top cap height Z may be essentially zero, as in exemplary garbage guard apparatus 400 illustrated in FIG. 7. Similarly, in exemplary garbage guard apparatus 400, in which the top cap 440 is formed of solid material 446, the top cap height Z may have some finite value to slant top cap 440, as in garbage guard apparatus 10 illustrated in FIG. 2B. In certain implementations, at least portions of top cap edge 448 may be non-sealingly disposed with respect to sidewall 417 to allow air to pass between top cap edge 448 and sidewall 417 in order to relieve vacuum pressures within passage 435 that may cause siphoning or cavitation.

Figure 8:
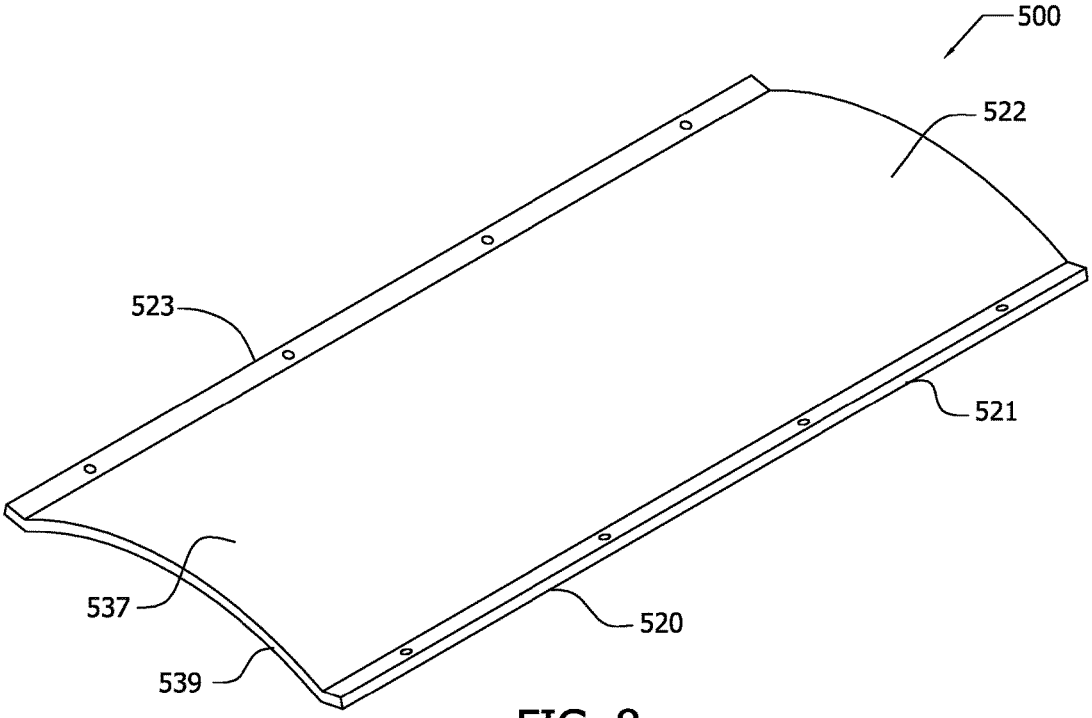
FIG. 8 illustrates by perspective view a sixth exemplary garbage guard apparatus.

FIG. 8 illustrates portions of exemplary garbage guard apparatus 400 including panel 522 that is curved in the horizontal (W) dimension, in this implementation. Panel 522 includes flanges 521, 523 that are faced toward outer side 537 of panel 522. Several panels such as panel 522 may be flangably secured to one another to form a panel assembly 520 with inner side 539 defining at least in part a passage, such as such as passage 35, 135, 235, 335, 435. In other implementations, the panel(s) may, for example, be curved in the vertical dimension or in both the horizontal and vertical dimensions.

Figure 9A:
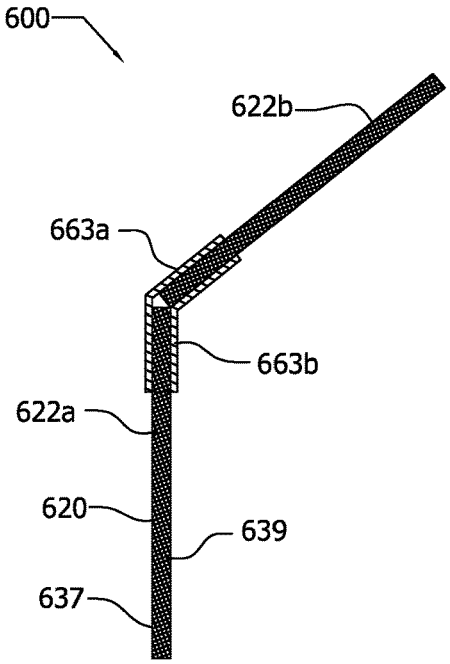
FIG. 9A illustrates by top view portions of a seventh exemplary garbage guard apparatus.
Figure 9B:
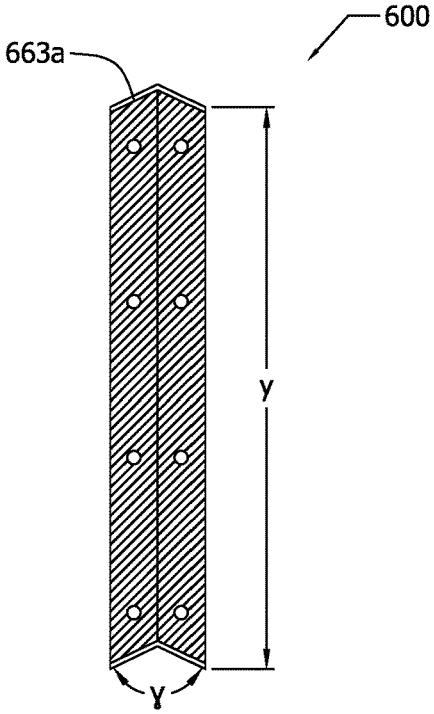
FIG. 9B illustrates by perspective view portions of the seventh exemplary garbage guard apparatus of FIG. 9A; and, FIG. 10 illustrates by process flow chart an exemplary process of assembly of a panel assembly of a garbage guard apparatus, such as the exemplary garbage guard apparatus of FIG. 1A, FIG. 4, FIG. 5, FIG. 6A, FIG. 7, FIG. 8, and FIG. 9A.

FIGS. 9A, 9B illustrate portions of exemplary garbage guard apparatus 500 including panels 622*a*, 622*b* secured to one another by angle brackets 663*a*, 663*b* to form at least a portion of panel assembly 620. In this implementation, panels 622*a*, 622*b* are flat sheets of material such as sheet steel or sheet aluminum, stainless steel, HPDE or combinations thereof devoid of flanges, and angle brackets 663*a*, 663*b*, nay be formed, for example, of steel, aluminum, stainless, steel, fiberglass, various plastics such as HPDE, and combinations thereof. Angle bracket 663*a* is secured to panels 622*a*, 622*b* about outer side 637 of panel assembly 620, and angle bracket 663*b* is secured to panels 622*a*, 622*b* about inner side 639 of panel assembly 620, in this implementation. Various fasteners may be used to secure angle brackets 663*a*, 663*b* to panels 622*a*, 622*b*, and various pre-drilled holes that accommodate the fasteners may be provided matchingly in angle brackets 663*a*, 663*b* and in panels 622*a*, 622*b*. Various combinations of angle brackets, such as angle brackets 663*a*, 663*b* may be used to secure panels 622*a*, 622*b* to one another about outer side 637, inner side 639, or both outer side 637 and inner side 639. For example, both angle brackets 663*a*, 663*b* may be utilized as illustrated, while, in other implementations, only angle bracket 663*a* is utilized. As illustrated in FIG. 9B, angle bracket 663*a* has height Y that matches the height of panels 622*a*, 622*b*. In other implementations, angle bracket 663*a* may have a height less than panel height Y with several angle brackets being disposed lengthwise to secure panels 622*a*, 622*b* to one another. Angle brackets 622*a*, 622*b* define angle $\gamma$ at which panels 622*a*, 622*b* are positioned with one another, and angle $\gamma$ may range from about 90° to about 180°, in various implementations.

Figure 10:
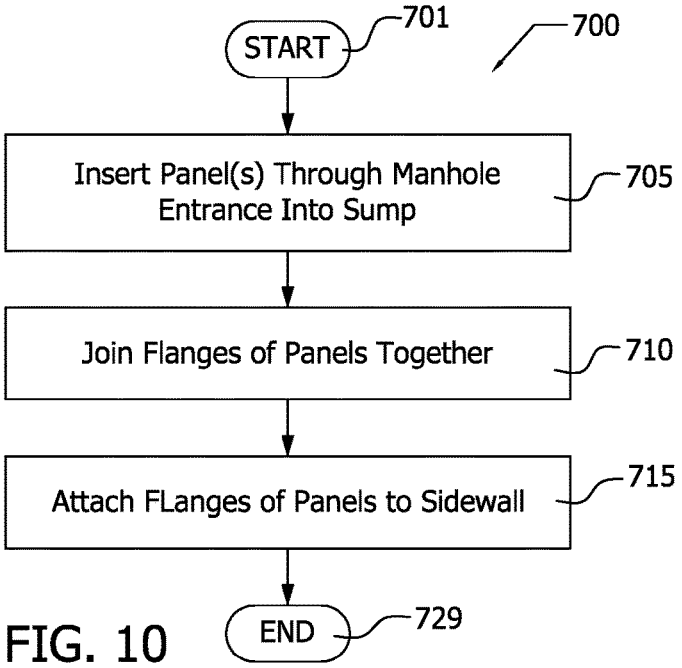

FIG. 10 illustrates exemplary process of assembly 700 of a panel assembly of a garbage guard apparatus, such as panel assembly 20, 120, 220, 320, 420, 520, 620 of garbage guard apparatus 10, 100, 200, 300, 400, 500, 600 respectively. Process of assembly 700 starts at step 701. At step 705, panels, such as panels 22*a*, 22*b*, 22*c*, 122*a*, 122*b*, 222*a*, 222*b*, 222*c*, 222*d*, 322*a*, 322*b*, 322*c*, 422*a*, 422*b*, 422*c*, 522, 622*a*, 622*b*, are inserted into the sump, such as sump 18, 118, 218, 218, 318 of a manhole, such as manhole 12, 112, 212, 312, through a manhole entrance, such as manhole entrance 19. The panels are sized to pass through the manhole entrance and to be received within and manipulated for assembly within the sump (i.e., width W is less than diameter d of the manhole entrance), in various implementations. The panels may be lengthwise self-symmetric and symmetric with respect to one another so that the panels mate with one another irrespective of orientation.

With the panels received within the sump, the flanges, such as flanges 33*a*, 31*b*, 33*b*, 31*c*, flanges 133*a*, 131*b*, and flanges 233*a*, 231*b*, 233*b*, 231*c*, 233*c*, 231*d*, are joined together to form the panel assembly, at step 610. Flanges, such as flanges 31*a*, 33*c*, flanges 131*a*, 133*b*, and flanges 231*a*, 233*d*, are attached to the sidewall, such as sidewall 17, 177, 217, 317, 417 of the sump, at step 615. Fasteners, such as fasteners 42*a*, 42*b*, 42*c*, 42*d*, may be used to join the flanges together, and fasteners, such as fasteners 44*a*, 44*b*, may be used to attached the panel assembly to the sidewall. Holes, such as holes 43*a*, 43*b*, 43*c*, 43*d* and holes 44*a*, 44*b*, may be disposed about the flanges to receive fasteners that join the flanges together or secure the flanges to the sidewall. Spacers, such as spacers 51*a*, 51*b*, may be interposed between the flanges during the joining of the flanges together, in certain implementations. Alternatively, angle brackets, such as angle brackets 663*a*, 663*b*, may be utilized to join together panels, such as panels 622*a*, 622*b*, that are devoid of flanges. Angle brackets may be used to reinforce flanges, in certain implementations.

The panels may be manipulated using ports, such as ports 29*a*, 29*b*, 29*c*, 29*d*, 29*e*, 29*f*, 429*a*, 429*b*, 429*c*, 429*d*, as the panels are inserted through the manhole entrance into the sump, as the panels are manipulated within the sump during assembly of the panel assembly, or as the panel assembly is attached to the sidewall. A cable, such as cable 63, may be removably engaged the panels using the ports, and the cable or cable and panel in combination may be manipulated either by hand or mechanically. When the cable is attached to the port, the height H of the panel is oriented vertically by gravity so that width W passes through the manhole entrance and the panel is oriented for attachment to other panels in order to form the panel assembly.

A top cap, such as top cap 40, 440, may be placed over a passage, such as passage 35, 135, 235, 335, 435, defined by the panel assembly at upper end, such as upper end 26, 426, of the panel assembly. Steps 710, 715 may be performed consecutively in either order or steps 710, 715 may be performed concurrently at the choice of the user. Exemplary process of assembly 700 ends at step 729.

In operation of the garbage guard apparatus, water, such as water 95, 195, 295, 395, flows from an inflow pipe (or pipes), such as inflow pipe 13, 113, 213, 273, 313, into the sump. Water may flow into the sump through the manhole entrance. The water then passes from the sump through the passage defined by the panel assembly into a pipe entrance, such as pipe entrance 16, 116, 216, 316 of an outflow pipe such as outflow pipe 15, 115, 215, 315. Garbage, such as garbage 99, is held by buoyant forces proximate a water surface, such as water surface 97 of the water in the sump as the water is drawn into the passage so that the panel assembly prevents the garbage from being drawn into the outflow pipe. The panel assembly skims garbage from the water surface as the water flows through the passage into the outflow pipe. A top cap, such as top cap 40, 440, may enclose the passage at the upper end, such as upper end 26, 426, of the panel assembly to prevent garbage from being carried into the passage in the event the panels of the panel assembly are overtopped. The top cap may be slanted to prevent garbage from accumulating on the top cap. The top cap may be formed of a screen, such as screen 46, or of solid material, such as solid material 446, in various implementations. The top cap formed of solid material may skim garbage that includes floating liquids from the water when the water overtops the panel assembly. A flow baffle, such as flow baffle 360, may be interposed in the sump between the pipe exit, such as pipe exit 14, 114, 214, 274, 314, of the inflow pipe and the panel assembly to enhance capture of sediment in the sump. The user may then remove garbage or sediment accumulated in the sump as needed.

The foregoing discussion along with the Figures discloses and describes various exemplary implementations. These implementations are not meant to limit the scope of coverage, but, instead, to assist in understanding the context of the language used in this specification and in the claims. Upon study of this disclosure and the exemplary implementations herein, one of ordinary skill in the art may readily recognize that various changes, modifications and variations can be made thereto without departing from the spirit and scope of the inventions as defined in the following claims.

The invention claimed is:

1. A garbage guard apparatus, comprising:

a sump comprising an outflow pipe with an outflow pipe entrance to convey water from the sump, the sump accessed through a manhole entrance of diameter d;

multiple panels, each panel of the multiple panels having panel width W that is less than diameter d for passage of each panel through the manhole entrance into the sump, and a flange on each longitudinal side of each panel, all flanges being symmetric to allow a flange of one panel to mate with any flange of any other panel;

a panel assembly formed by flanged securement of the multiple panels to one another while the panels are within the sump, the panel assembly so formed attached about the outflow pipe entrance of the outflow pipe with a lower end below an invert of the pipe entrance and an upper end above a crown of the pipe entrance, the panel assembly defines a passage and the water passes from the sump around the lower end into the passage and thence into the pipe entrance of the outflow pipe with buoyant garbage being retained within the sump by the panel assembly.

2. The apparatus of claim 1, further comprising:

a top cap secured about the upper end to exclude garbage from the passage when water overtops the upper end.

3. The apparatus of claim 2, the top cap comprises a screen.

4. The apparatus of claim 2, the top cap comprises a solid material.

5. The apparatus of claim 2, the top cap being disposed generally in a horizontal plane.

6. The apparatus of claim 2, at least portions of the top cap being elevated with respect to the upper end of the panel assembly.

7. The apparatus of claim 1, each panel of the multiple panels being of similar panel width.

8. The apparatus of claim 1, at least one of the multiple panels being curved.

9. The apparatus of claim 1, each panel of the multiple panels including a port for attachment of a cable thereto for lowing of the panel into the sump.

10. The apparatus of claim 1, further comprising:

a flow baffle of planar configuration and having opening disposed in the flow baffle to create a percent of open area of about 40% to about 50%, the flow baffle emplaced within the sump between a pipe exit of an inflow pipe and the panel assembly to intersect a centerline of the inflow pipe with a plane defined by the baffle, the plane oriented vertically, a bottom of the flow baffle raised above a sump floor of the sump to define a gap between the bottom and the sump floor for flow of water therethrough.

11. A garbage guard apparatus, comprising:

multiple panels secured to one another to form a panel assembly, the panel assembly attached about a pipe entrance of an outflow pipe within a sump, wherein a lower end of the panel assembly is positioned below an invert of the pipe entrance and an upper end of the panel assembly is positioned above a crown of the pipe entrance and water flows from the sump around the lower end of the panel assembly into a passage defined by the panel assembly and thence into the pipe entrance thereby retaining buoyant garbage within the sump.

12. The apparatus of claim 11, further comprising:

a top cap securable about the upper end to exclude garbage from the passage when water overtops the upper end.

13. The apparatus of claim 12, the top cap comprises a screen.

14. The apparatus of claim 12, the top cap comprises a solid material.

15. The apparatus of claim 11, further comprising:

a flow baffle of planar configuration and having opening disposed in the flow baffle to create a percent of open area of about 40% to about 50%, the flow baffle emplaceable within the sump between a pipe exit of an inflow pipe and the panel assembly to intersect a centerline of the inflow pipe with a plane defined by the baffle, the plane being oriented vertically, a bottom of the flow baffle raised above a sump floor of the sump to define a gap between the bottom and the sump floor for flow of water through the gap.

16. A garbage guard apparatus, comprising:

a sump comprising an outflow pipe with an outflow pipe entrance to convey water from the sump, the sump accessed through a manhole entrance of diameter d;

multiple panels, each panel of the multiple panels having panel width W that is less than diameter d for passage of each panel through the manhole entrance into the sump;

one or more angle brackets separate from the panels;

a panel assembly formed by securement of the multiple panels to one another using the one or more angle brackets while the panels are within the sump, the panel assembly so formed attached about the outflow pipe entrance of the outflow pipe with a lower end below an invert of the pipe entrance and an upper end above a crown of the pipe entrance, the panel assembly defines a passage and the water passes from the sump around the lower end into the passage and thence into the pipe entrance of the outflow pipe with buoyant garbage being retained within the sump by the panel assembly.

17. The apparatus of claim 16, further comprising:

a flange on each longitudinal side of each panel, all flanges being symmetric to allow a flange of one panel to mate with any flange of any other panel for flangeable securement of the panels to one another.

18. The apparatus of claim 16, further comprising:

a top cap for the capture of garbage at the upper end of the panel assembly.

19. The apparatus of claim 16, at least one of the multiple panels being curved.

20. The apparatus of claim 16, each panel of the multiple panels including a port for attachment of a cable thereto for lowing of the panel into the sump.

* * * * *